US011850723B2

(12) United States Patent
Gubellini et al.

(10) Patent No.: US 11,850,723 B2
(45) Date of Patent: Dec. 26, 2023

(54) BALANCER FOR TOOLS

(71) Applicant: TECNA S.P.A., Castel San Pietro Terme (IT)

(72) Inventors: Fabio Gubellini, Imola (IT); Andrea Lolli, Budrio (IT); Damiano Bergami, Castel Guelfo di Bologna (IT)

(73) Assignee: TECNA S.P.A., Castel San Pietro Terme (IT)

( * ) Notice: Subject to any disclaimer, the term of this patent is extended or adjusted under 35 U.S.C. 154(b) by 384 days.

(21) Appl. No.: 17/059,807

(22) PCT Filed: May 29, 2018

(86) PCT No.: PCT/IT2018/000078
§ 371 (c)(1),
(2) Date: Nov. 30, 2020

(87) PCT Pub. No.: WO2019/229778
PCT Pub. Date: Dec. 5, 2019

(65) Prior Publication Data

US 2021/0205978 A1 Jul. 8, 2021

(51) Int. Cl.
*B65H 75/48* (2006.01)
*B25H 1/00* (2006.01)

(52) U.S. Cl.
CPC ..... *B25H 1/0028* (2013.01); *B65H 75/483* (2013.01); *B65H 75/486* (2013.01)

(58) Field of Classification Search
CPC ... B65H 1/0028; B65H 75/483; B65H 75/486
See application file for complete search history.

(56) References Cited

U.S. PATENT DOCUMENTS

| | | | | |
|---|---|---|---|---|
| 4,443,888 | A | 4/1984 | Cutter | |
| 6,241,462 | B1 | 6/2001 | Wannasuphoprasit et al. | |
| 6,561,451 | B1 | 5/2003 | Steinich | |
| 2003/0192974 | A1* | 10/2003 | Hopper | B65H 75/483 242/376 |
| 2005/0051406 | A1* | 3/2005 | Hopper | B65H 75/486 248/330.1 |

(Continued)

FOREIGN PATENT DOCUMENTS

| | | |
|---|---|---|
| CN | 1208827 A | 2/1999 |
| CN | 101337645 A | 1/2009 |

(Continued)

OTHER PUBLICATIONS

International Search Report dated Mar. 26, 2019 re: Application No. PCT/IT2018/000078, pp. 1-4, citing: CN 105 984 820 A, US 2008/0072443 A1, EP 1 976 790 A2, US 6 241 462 B1, US 2003/0192974 A1, EP 1 014 031 A2 and US 4 443 888 A.

(Continued)

*Primary Examiner* — Sang K Kim
(74) *Attorney, Agent, or Firm* — CANTOR COLBURN LLP

(57) ABSTRACT

A balancer for tools includes a rotary drum for winding and unwinding a cable, which is adapted with a free end thereof to support a tool. The balancer also includes a spring, wound around the main rotation axis of the drum, which is adapted to develop an elastic reaction contrasting the unwinding of the cable.

6 Claims, 4 Drawing Sheets

(56) References Cited

U.S. PATENT DOCUMENTS

| | | | |
|---|---|---|---|
| 2007/0205405 | A1 | 9/2007 | Stockmaster et al. |
| 2008/0072443 | A1 | 3/2008 | Powell |

FOREIGN PATENT DOCUMENTS

| | | | |
|---|---|---|---|
| CN | 103056854 | A | 4/2013 |
| CN | 105984820 | A | 10/2016 |
| DE | 29704761 | U1 | 5/1997 |
| EP | 0866023 | A2 | 9/1998 |
| EP | 1014031 | A2 | 6/2000 |
| EP | 1976790 | A2 | 10/2008 |
| JP | H1179685 | A | 3/1999 |
| JP | 2015054762 | A | 3/2015 |
| WO | 2007084553 | A2 | 7/2007 |

OTHER PUBLICATIONS

Written Opinion dated Mar. 26, 2019 re: Application No. PCT/IT2018/000078, pp. 1-5, citing: CN 105 984 820 A and US 2008/0072443 A1.

Chinese Office Action for Chinese Application No. 2018800940263, dated Mar. 27, 2023, 7 pages.

* cited by examiner

BALANCER FOR TOOLS

TECHNICAL FIELD

The present disclosure relates to a balancer for tools.

BACKGROUND

As is known, in the state of the art (and therefore in the present discussion) the term "balancer" identifies a device that is used in workshops and production areas, to provide assistance to an operator who is availing of any form of tool to carry out work of various nature.

In more detail, the balancer comprises a rotatable drum hung from the ceiling, around which a cable is wound; the cable is fixed at one end to the drum proper and at the other end is provided with a hook, so that the tool can be attached thereto.

The balancer likewise has a spring, typically spiral, wound about the rotation axis of the drum: unwinding the cable, with consequent rotation of the drum and descent of the tool, generates a constraining reaction of the spring, which balances (or exceeds) the weight of the tool itself.

In some applications, the task of the elastic reaction is simply to keep the tool at the desired vertical height, so as to enable the operator to handle even very heavy instruments without effort.

In other cases, for example when several tools serve the same work station and are usually kept in dedicated seats, each one of them is associated with a respective balancer. Thus, the operator can easily retrieve the tool he/she needs and use it for the desired purposes and, when he/she has finished, the elastic reaction of each spring steps in to reposition the tool in the seat, thus ensuring only the correct placement and ensuring the work station is always kept tidy.

Such implementation solutions are not devoid of drawbacks, however.

Over time, as a consequence of repeated unwinding and winding cycles of the cable, there is a progressive deterioration of the cable proper and of the other components involved. Such phenomenon (and, more generally, the frequency of malfunctions and damage) is accentuated if the operator does not accompany the return of the cable, after having disengaged the tool from the hook. Sometimes in fact, the elastic reaction developed by the spring is considerable and therefore in the return the hook accelerates appreciably, and will impact violently against the drum and/or the other components hung from the ceiling, with evident unwanted consequences.

It should also be noted that in order to be capable of varying the intensity of the elastic reaction of the spring, often balancers are provided with devices for adjusting the preloading of the spring proper. Again, apart from a natural and progressive loss of reliability of such devices, not infrequently abuses are seen in their use, which accentuate the risk of damage or malfunctions or further shorten the useful life of the balancer.

However, it is extremely difficult to prevent the damage and in general to carry out maintenance and preventive or corrective operations in the time allotted, both because often the problems are hidden (until serious damage occurs), and because not infrequently the balancer attracts little attention from the staff of the department responsible, being a device that is sometimes (incorrectly) perceived as auxiliary and of low importance.

SUMMARY

The aim of the present disclosure is to solve the above mentioned problems, by providing a balancer for tools that is provided with effective methods of monitoring the reliability and the state of wear/deterioration of one or more of its components.

Within this aim, the disclosure provides a balancer that is provided with effective methods of autonomous monitoring, that is to say, capable of operating without requiring a source of energy for its power.

The disclosure also provides a balancer that is capable of supervising various operating and functional parameters thereof, while at the same time ensuring the possibility of planning effective preventive maintenance actions.

The disclosure further provides a balancer that enables practical methods of monitoring and processing its operating parameters, also remotely.

The disclosure provides a balancer that adopts an alternative technical and structural architecture to those of conventional balancers.

The disclosure further provide a balancer that can be easily implemented using elements and materials that are readily available on the market.

The disclosure advantageously provides a balancer that is low cost and safely applied.

This aim and these and other advantages which will become better apparent hereinafter are achieved by providing a balancer for tools, which comprises a rotary drum for winding and unwinding a cable, which is adapted with a free end thereof to support a tool, and a spring, wound around the main rotation axis of said drum, which is adapted to develop an elastic reaction contrasting the unwinding of said cable, characterized in that it comprises a measurement transducer for measuring at least one parameter correlated to the rotation of said drum about said main axis and a respective assembly for supplying electric power to said transducer.

BRIEF DESCRIPTION OF THE DRAWINGS

Further characteristics and advantages of the disclosure will become better apparent from the detailed description that follows of a preferred, but not exclusive, embodiment of the balancer for tools according to the disclosure, which is illustrated by way of non-limiting example in the accompanying drawings wherein.

DETAILED DESCRIPTION OF THE DRAWINGS

Figure 1:
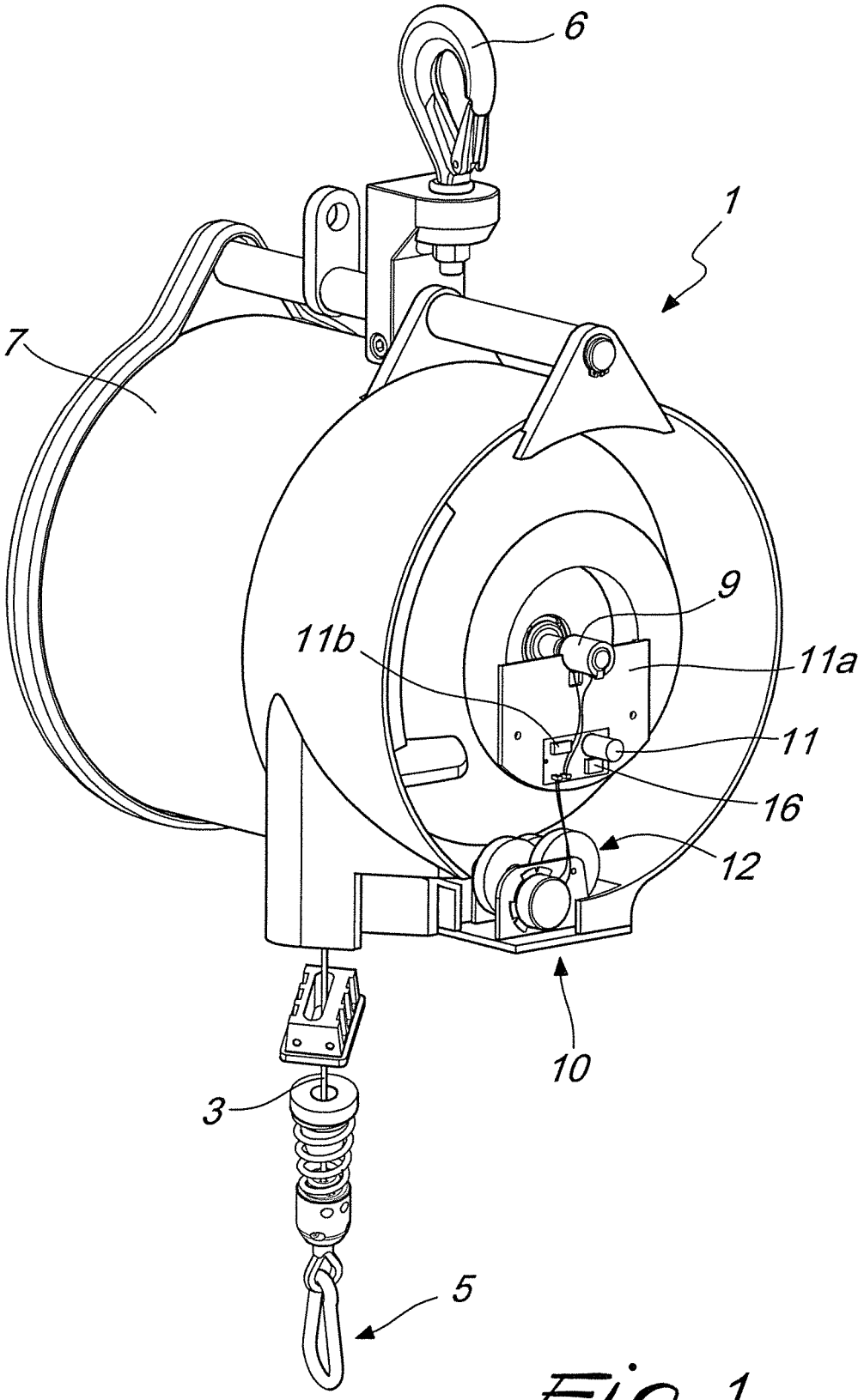
FIG. 1 is a schematic perspective view of the balancer according to the disclosure.
Figure 2:
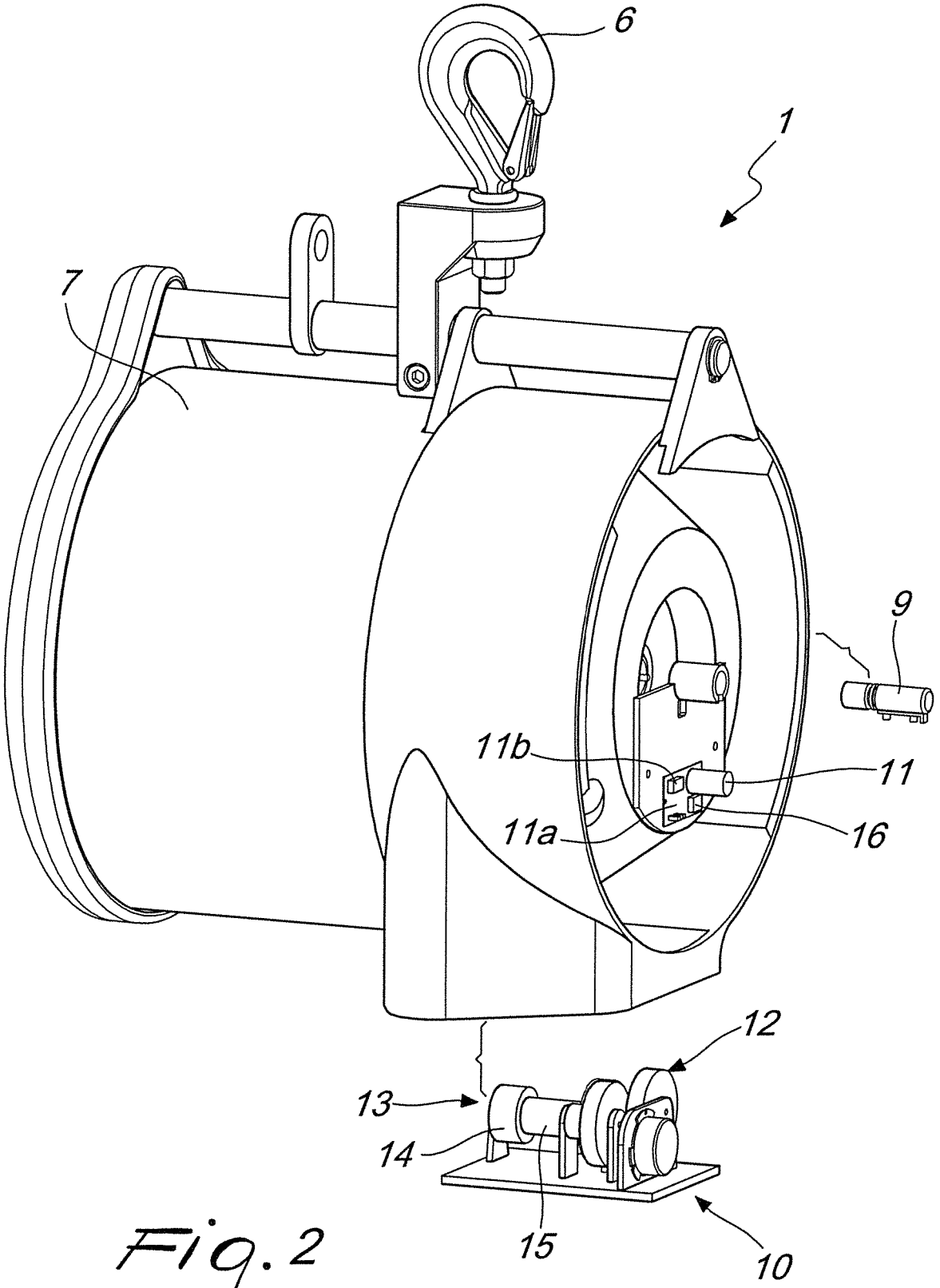
FIG. 2 is a partially exploded perspective view, taken from a different angle, substantially of the balancer of FIG. 1.

With reference to the figures, the reference numeral 1 generally designates a balancer for tools, which comprises a rotary drum 2 for winding and unwinding a cable 3.

With a free end thereof (on the other end from the drum 2), the cable 3 is adapted to support a tool, of any kind, weight, shape and/or function.

Figure 3:
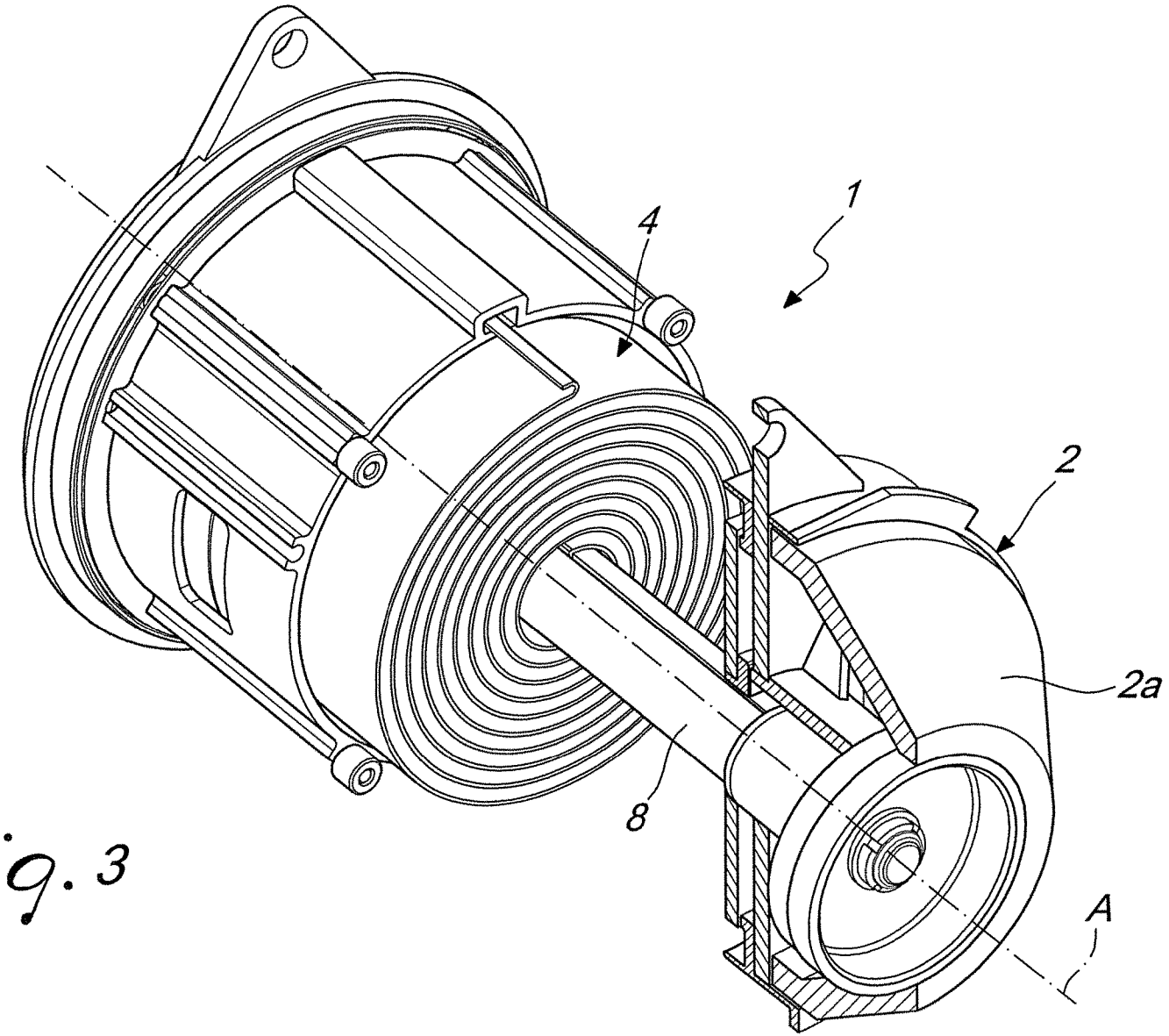
FIG. 3 is a partially cross-sectional perspective view substantially of the balancer of FIG. 1, with some elements removed.
Figure 4:
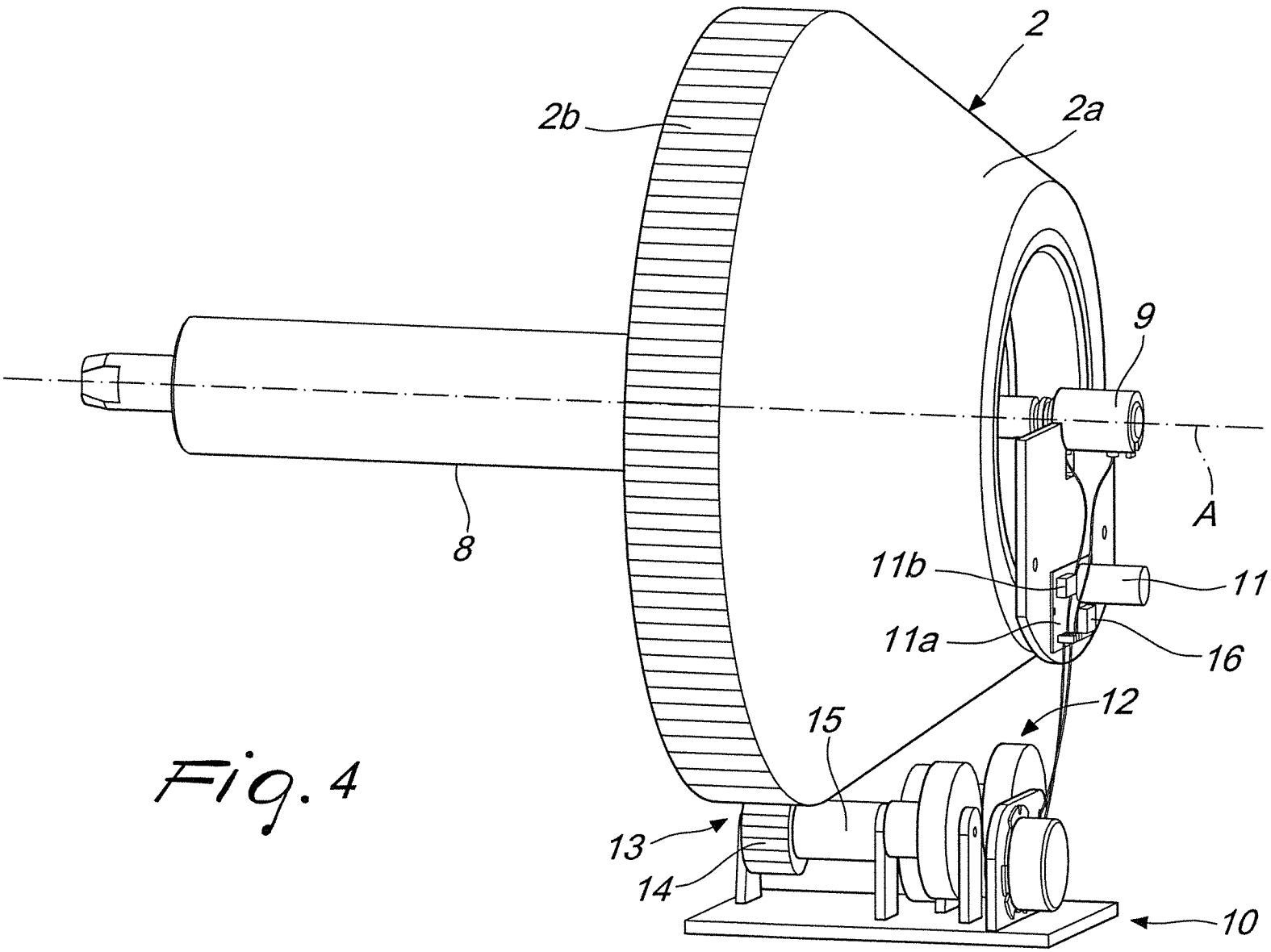
FIG. 4 is a perspective view of some components of the balancer of FIG. 1.

Furthermore, the balancer 1 comprises a spring 4 wound around the main rotation axis A of the drum 2 (for the sake of simplicity, the main axis A is shown only in FIGS. 3 and 4).

The spring 4 is adapted to develop an elastic reaction that contrasts the unwinding of the cable 3; it is therefore capable of causing the rewinding of the cable 3, after it has been unwound.

Up to here, the balancer 1 is of the conventional type, and can be used (preferably but not exclusively) to offer valuable assistance to operators who need to carry out tasks of various nature while availing of a tool, which can be temporarily hooked to the cable 3 (for example by way of a spring-clip 5).

In fact, the balancer 1 is typically hung from the ceiling, for example by virtue of a hook 6 coupled to a shell 7 for accommodating the drum 2, and the elastic reaction of the spring 4 (typically but not exclusively of the spiral type) reduces or cancels out the weight of the tool, even if this is considerable, thus facilitating its use. Furthermore, or as an alternative, in some applications the elastic reaction of the spring 4 acts to return the tool to a rest station, when it is released by the operator.

The balancer 1 can likewise be provided with other conventional components and contrivances, in order to give it other useful functionalities. For example, the balancer 1 can comprise a device for adjusting the preloading of the spring 4 and/or a device for braking the cable 3, in order to slow its rewinding.

The drum 2 can be cylindrical or conical/frustum-shaped (as in the accompanying figures, in which the cable 3 is wound around its lateral conical portion 2*a*), or another shape, while remaining within the scope of protection claimed herein.

Preferably, the drum 2 is likewise mounted integrally on a main shaft 8, which extends along (and defines) the main axis A.

According to the disclosure, the balancer for tools 1 comprises a measurement transducer 9 for measuring at least one parameter correlated to the rotation of the drum 2 about the main axis A.

Furthermore, the balancer 1 comprises an assembly 10 for supplying electric power for the transducer 9.

The presence of the transducer 9 makes it possible from this point onward to achieve the set aim, since the acquisition of data related to the rotation of the drum 2 makes it possible to obtain information on the conditions of wear/deterioration of the balancer 1 and in general on its reliability.

In particular, while not ruling out other practical solutions, in the preferred embodiment the transducer 9 is an encoder, adapted to measure the rotation and/or the number of revolutions of the drum 2 about the main axis A. More generally, the encoder acts to measure the angular position of the drum 2, which is variable by virtue of its rotation about the main axis A.

With further reference to the preferred embodiment, the assembly 10 for supplying electric power comprises a condenser 11, adapted to accumulate electric power and transfer it to the transducer 9. The condenser 11 therefore acts to accumulate electric power obtained in various ways and it can be supplied with an internal or external power source; in any case, the electric power is then progressively transferred to the transducer 9, thus enabling it to be fully operational. Any method of supplying power to the condenser 11 should in any case be considered to remain within the scope of protection claimed herein. The condenser 11 can be installed on an electronic card 11*a* which is provided with other components and accessories, such as for example a charge control chip 11*b*.

More generally, it should be noted that the transducer 9 proper can be powered in any way (i.e. even without using the condenser 11), and for example by way of an external power source, for example by connecting it to the mains electricity supply, or by providing the balancer 1 with an electric or other type of storage cell, in any case to be placed in operational connection with the transducer 9.

In the preferred, but not limiting, embodiment of the application of the disclosure, the assembly 10 for supplying electric power comprises an apparatus for recovering and/or converting a fraction of the energy developed during the rotation of the drum 2 (or more generally during the operation of the balancer 1 proper).

The choice to use such apparatus is found to be of undoubted practical interest, since it renders the transducer 9 effectively self-sufficient and it removes the need to provide specific devices and contrivances for its power supply.

It should be noted that the apparatus can be of any type and in particular it can be designed to recover and/or to convert any form of energy developed during the rotation of the drum 2, be it thermal, luminous, mechanical etc.

In an embodiment of significant practical interest, which in any case does not limit the application of the disclosure, the apparatus comprises a converter 12 of the mechanical energy developed during the rotation of the drum 2 to electric power.

It should be noted that during normal operation the drum 2 rotates whenever the cable 3 is unwound (under the weight of a tool coupled to the spring-clip 5 and/or by virtue of the action of an operator) or is wound (recalled by the elastic reaction of the spring 4): in all these situations therefore, a part of the mechanical energy is converted to electric power by the converter 12, which can for example be a dynamo or other high-speed motor (or the like).

It should be emphasized that in the preferred embodiment the converter 12 supplies the condenser 11 which in turn, as has been seen, transfers electric power to the transducer 9. Nonetheless, other methods are not ruled out of transferring the electric power obtained from the converter 12 to the transducer 9.

The converter 12 is associated with the main shaft 8 in any manner, direct or indirect, while remaining within the scope of protection claimed herein.

In the preferred embodiment, conveniently the balancer for tools 1 according to the disclosure comprises gear means 13, interposed between the main axis A (the main shaft 8) and an input shaft of the converter 12, for varying (and preferably increasing) the number of revolutions.

In particular, in a possible embodiment, which is illustrative and does not limit the application of the disclosure, the means 13 comprise a lateral band of the drum 2, which is provided with a respective toothing 2*b* (shown for the sake of simplicity only in FIG. 4), and a gearwheel 14, which meshes with the toothing 2*b*.

The gearwheel 14 is keyed on an auxiliary shaft 15, parallel to the main axis A (to the main shaft 8) and is arranged in communication, directly or indirectly, with the input shaft of the converter 12.

Additional toothed elements can be interposed between the converter 12 and the gearwheel 14 and/or the main axis A.

Advantageously, the balancer 1 comprises an electronic data processing module, adapted at least to acquire and process the data detected by the transducer 9.

Such electronic data processing module can effectively be an electronic controller or other electronic unit incorporated in the transducer 9 or in any case in the balancer 1 (in one of its components). The possibility is not ruled out however of implementing in the balancer 1 other types of hardware platforms, reprogrammable or not, provided or not with a microprocessor and incorporating or defining the mentioned electronic module.

In particular, the electronic module is provided with instructions in order to determine the number of unwinding and winding cycles of the cable 3 and/or the absolute position of the cable 3, based on the number of revolutions of the drum 2 about the main axis A.

An unwinding and winding cycle is a round of unwinding and rewinding (return) of the cable 3, and can be counted even if the cable 3, within a single round, is not fully unwound.

In any case in fact, the processing module is capable of determining the number of cycles based on the measurement of the rotation of the drum 2 about its own main axis A, carried out by the transducer 9.

Monitoring the number of cycles (and in general of the distance traveled from any point of the cable 3 and/or from the spring-clip 5) is of fundamental importance, in that, by comparing similar information obtained on an adequate number of balancers 1 and taking account of the reports of malfunctions and breakdowns, it makes it possible to determine the average degree of reliability of the balancer 1. This evidently makes it possible to properly plan the preventive maintenance schedules.

In addition or as an alternative to what is mentioned above, the processing module can be provided with instructions in order to determine the preloading force of the spring 4, based on the number of revolutions of the drum 2 about the main axis A.

The preloading of the spring 4 is in fact also associated with the rotation of the drum 2 (on which the spring 4 is wound) and therefore by virtue of the transducer 9 it is possible to acquire useful information on this parameter as well, especially when the balancer 1 comprises a device for adjusting the preloading.

In fact, an initial calibration is carried out, with which a correlation is established between the status of the preloading of the spring 4 and the rotation of the encoder (preferably an absolute encoder). By virtue of the calibration, it is then possible to determine the value of the elastic reaction developed by the spring 4 and this makes it possible to discriminate against any overloads or sudden losses of preloading. Again, such information can then be used to carry out preventive maintenance.

Positively, the balancer for tools 1 according to the disclosure comprises at least one memory unit, adapted to store the data detected by the transducer 9.

The circuits of the memory unit (which can be conventional) are preferably configured to keep the data stored correctly even in the absence of power, so as to guard against their loss if the charge of the condenser 11 is lost.

Conveniently, the balancer 1 according to the disclosure comprises at least one user interface associated with the memory unit; the user interface is configured to make it possible to store information supplied by an operator in the memory unit.

For example, some information is entered during testing (or every testing) of the balancer 1, such as the serial number and date of testing.

Advantageously, the balancer 1 according to the disclosure comprises at least one transceiver module 16 (a chip for example, mounted on the electronic board 11*a*). The transceiver module 16 is associated with the transducer 9 and/or with the memory unit and/or with the electronic processing module. The transAceiver module 16 can be conventional and, preferably but not exclusively, can be able to establish a connection to the internet, in order to transmit the data over the internet. For example, there can be a data conversion system, to be connected to the mains electricity supply, in order to allow the transceiver module 16 to carry out its function.

In any case, the transceiver module 16 is configured to establish a communication session with a remote data bank and/or a remote electronic processing unit, at least for distance sending of the data detected by the transducer 9.

The remote data bank and the remote electronic unit can for example be located at (or in any case managed by) the company that makes the balancer 1, so that this company can accumulate data on a plurality of balancers 1 installed in different contexts, obtain statistical data and formulate predictions on the lifetime and reliability of the components, in order to best draw up preventive maintenance schedules and/or adopt the necessary countermeasures to extend the life of the balancers 1 proper.

It should be noted that the remote electronic unit can likewise carry out the functions already described for the electronic processing module, as an alternative or in addition to the latter.

Conveniently, the balancer 1 according to the disclosure comprises a temperature sensor, to monitor the surrounding environmental conditions.

In an embodiment of significant practical interest, the balancer 1 comprises an accelerometer, adapted to measure the acceleration profiles of the cable 3 and/or of the drum 2 (and/or to detect any oscillations of the components associated therewith).

The temperature sensor and/or the accelerometer can in turn be associated with the memory unit, with the electronic data processing module, and/or with the transceiver module 16, in order to be capable of storing, processing and/or transmitting the data acquired by them.

It should likewise be noted that other components among the ones described above (the temperature sensor, the accelerometer etc.), as well as the transducer 9, can be powered directly or indirectly with the condenser 11 and/or with the recovery and/or conversion apparatus, so as to keep the energy consumption of the balancer 1 low (or even nil).

Operation of the balancer according to the disclosure is therefore evident from the discussion in the paragraphs above.

According to methods that are known per se, and for example by virtue of the hook 6, the balancer 1 can be hung from the ceiling (or from a wall) of a room in which an operator wishes to avail of a tool of any kind in order to carry out an activity.

The tool can in fact be coupled temporarily to the spring-clip 5 fitted at one end of the cable 3, which in turn can be unwound at least partially from the drum 2 in order to move the spring-clip 5 to within reach of the operator.

During the carrying out of the activity, the elastic reaction of the spring 4 can compensate for the weight of the tool, thus facilitating the work of the operator. Alternatively, or in addition to such functionality, the elastic reaction of the spring 4 can determine the rewinding of the cable 3 at the end of the activity. This can occur after disengaging the spring-clip 5 from the tool, or indeed leaving them mutually coupled, in which case the function of the balancer 1 is to return the tool proper to a predefined rest position and keep it there.

In any case, the unwinding and the rewinding of the cable 3 correspond to a rotation of the drum 2 on which it is wound (and of the main shaft 8 on which the drum 2 is integrally mounted).

Even when it is intended to provide a determined preloading to the spring 4, or subsequently vary it, there is a rotation of the drum 2 about the main axis A, since the spring 4 is in any case wound around the main shaft 8.

The extent of the rotation of the drum 2 and/or its number of revolutions are therefore measured by the transducer 9, which thus makes it possible to acquire essential information on the operation and reliability of the balancer 1, in a practical and easy manner.

In has already been shown in fact how the information about the number of revolutions makes it possible to find and keep track of the number of winding and unwinding cycles of the cable 3, as well as, more simply, the position of the cable 3 instant by instant. Furthermore, by virtue of the transducer 9 it is possible to know the preloading force applied on the spring 4.

Firstly, the transducer 9 therefore makes it possible to obtain information on the current conditions of the balancer 1 (position of the cable 3, force applied on the spring 4, etc), which is useful for various reasons (even simply in order to view the information on an adapted display). The rotation speed of the drum 2 can also be easily obtained by virtue of the transducer 9.

In addition to the exact data, the information indicated above takes on critical relevance once it has been aggregated and associated with the information on the occurrence of any malfunctions and deterioration, in particular when compared with the information obtained from other balancers 1.

In fact, in this manner it is possible to derive major indications on the reliability of the system and on the average lifetime of the components, including obviously as a function of their more or less regular use.

Further information is obviously obtained when the balancer 1 also comprises other measurement components, such as the accelerometer and the temperature sensor, which are useful for building an even more detailed picture of the behavior over time of the balancer 1, as a function of the specific modes and conditions of use as well.

Such information is collected and made available to interested parties practically autonomously and without requiring any specific intervention by the people who use the balancer 1, thus freeing these people from a duty that often they do not want and which does not form part of their normal activities (and which in all probability they would neglect to carry out).

It should be noted that evidently the disclosure also allows indications of any abuses, for example when the transducer 9 supplies indications of frequent and excessive actions to adjust the preloading of the spring 4, or when the accelerometer detects an excessively fast return stroke, the consequence of which will probably be a violent impact of the spring-clip 5 on the shell 7.

Again, such information makes important analyses possible, for example to deduce the causes of malfunctions or damage.

All the information can be effectively stored in the memory unit and/or made available to a remote user, who has access to the remote data bank and/or to the remote electronic processing unit, to which the balancer 1 is functionally connected by virtue of the transceiver module 16.

In parallel, the choice to power the transducer 9 without using external sources of energy is extremely important.

In fact, in this manner the peculiar functionalities illustrated above are obtained without having to provide a specific power supply to the electrical/electronic components required, and therefore in any case keeping the cost of the system and its energy consumption low, and ensuring ease of installation and of use.

Such result can be obtained with the condenser 11 to which the electric power is supplied by the apparatus for recovering and/or converting a portion of the mechanical energy developed during the rotation of the drum 2, or even in another way, while remaining within the scope of protection claimed herein.

It has therefore been shown that the balancer 1, by virtue of the measurement transducer 9 and its assembly 10 for supplying electric power, makes it possible to monitor the reliability and the state of wear/deterioration of one or more of its components.

Such monitoring occurs autonomously, without requiring a source of electricity for its power supply.

The data collected by the transducer 9 (and by the other components that may be present) make it possible to supervise various operating and functional parameters thereof, while at the same time ensuring the possibility of planning effective preventive maintenance actions.

Moreover, the latter activities can effectively be carried out remotely.

The disclosure, thus conceived, is susceptible of numerous modifications and variations, all of which are within the scope of the appended claims. Moreover, all the details may be substituted by other, technically equivalent elements.

In the embodiments illustrated, individual characteristics shown in relation to specific examples may in reality be substituted with other, different characteristics, existing in other embodiments.

In practice, the materials employed, as well as the dimensions, may be any according to requirements and to the state of the art.

The invention claimed is:

1. A balancer for tools comprises a rotary drum configured for winding and unwinding a cable, which is adapted with a free end thereof to support a tool, and a spring, wound around a main rotation axis of said drum, which is adapted to develop an elastic reaction contrasting the unwinding of said cable, further comprising a measurement transducer configured for measuring at least one parameter correlated to the rotation of said drum about said main axis and a respective assembly configured for supplying electric power to said transducer, wherein said transducer is an encoder adapted to measure the rotation or a number of revolutions of said drum about said main axis, further comprising gear means, interposed between said main axis and an input shaft of a converter, for varying the number of revolutions.

2. The balancer according to claim 1, wherein said assembly for supplying electric power comprises a condenser adapted to accumulate electric power and transfer said electric power to said transducer.

3. The balancer according to claim 1, wherein said assembly for supplying electric power comprises an apparatus for recovering or converting a fraction of energy developed during the rotation of said drum.

4. The balancer according to claim 1, wherein said apparatus comprises said converter of mechanical energy developed during the rotation of said drum to electric power.

5. The balancer according to claim 1, wherein said gear means comprise a lateral band of said drum which has a respective toothing and a gearwheel, meshing with said toothing, and is keyed on an auxiliary shaft, parallel to said main axis and arranged in communication, directly or indirectly, with said input shaft of said converter.

6. The balancer according to claim 1, further comprising at least one transceiver module for distance sending of the data detected by said transducer.

* * * * *